US011998095B2

(12) United States Patent
Yoo

(10) Patent No.: US 11,998,095 B2
(45) Date of Patent: Jun. 4, 2024

(54) HANDMADE HANDBAG

(71) Applicant: WOORILABS CO., LTD., Seoul (KR)

(72) Inventor: Joonsik Yoo, Seoul (KR)

( * ) Notice: Subject to any disclaimer, the term of this patent is extended or adjusted under 35 U.S.C. 154(b) by 82 days.

(21) Appl. No.: 17/773,642

(22) PCT Filed: Feb. 26, 2021

(86) PCT No.: PCT/KR2021/002462

§ 371 (c)(1),
(2) Date: May 2, 2022

(87) PCT Pub. No.: WO2021/187769

PCT Pub. Date: Sep. 23, 2021

(65) Prior Publication Data

US 2022/0378159 A1 Dec. 1, 2022

(30) Foreign Application Priority Data

Mar. 18, 2020 (KR) ..... 10-2020-0033107

(51) Int. Cl.

| | |
|---|---|
| ***A45C 3/06*** | (2006.01) |
| ***A45C 3/00*** | (2006.01) |
| ***A45C 13/02*** | (2006.01) |
| ***A45C 13/08*** | (2006.01) |

(52) U.S. Cl.

CPC ..... *A45C 3/06* (2013.01); *A45C 3/001* (2013.01); *A45C 13/02* (2013.01); *A45C 13/08* (2013.01); *A45C 2003/002* (2013.01)

(58) Field of Classification Search

CPC ..... A45C 3/06; A45C 3/001; A45C 13/02; A45C 13/08; A45C 2003/002

See application file for complete search history.

(56) References Cited

U.S. PATENT DOCUMENTS 6,223,870 B1 * 5/2001 Godshaw ..... A45C 13/02 190/111
6,237,761 B1 * 5/2001 Godshaw ..... B65D 85/182 206/278

(Continued)

FOREIGN PATENT DOCUMENTS

JP 2001-258628 A 9/2001
KR 20-0378800 Y1 3/2005

(Continued)

*Primary Examiner* — Tri M Mai

(74) *Attorney, Agent, or Firm* — KORUS Patent, LLC; Seong Il Jeong

(57) ABSTRACT

The present invention relates to a handmade handbag that can be carried in a state in which portable items is stored therein, the handmade handbag configured to comprise a first handy storage part and a second handy storage part that are positioned on an outer portion of a storage part where the portable items are stored and that are mesh type partitioned structures for separately storing an item of the portable items that needs personal privacy protection and frequent taking out. The handmade handbag of the present invention provides a combination of a pattern type hiding cover and a through hole in the first and the second handy storage part to ensure air breathability inside, thereby preventing deterioration of a stored item and providing a beautiful appearance.

2 Claims, 10 Drawing Sheets

(56) References Cited

U.S. PATENT DOCUMENTS

| | | | | |
|---|---|---|---|---|
| 6,298,993 | B1 * | 10/2001 | Kalozdi | A45C 3/00 206/581 |
| 7,458,451 | B2 * | 12/2008 | Godshaw | A45C 13/04 190/107 |
| 8,272,505 | B2 * | 9/2012 | Melamed | A45C 13/103 190/111 |
| 10,092,072 | B2 * | 10/2018 | Capps-Tate | A45C 5/005 |
| 2009/0184014 | A1 * | 7/2009 | Lee | A45C 13/02 220/745 |
| 2013/0264363 | A1 * | 10/2013 | Ballou | B65D 25/04 224/42.32 |
| 2014/0197000 | A1 * | 7/2014 | Harrison | A45C 13/02 190/110 |

FOREIGN PATENT DOCUMENTS

| | | | |
|---|---|---|---|
| KR | 10-2013-0017180 | A | 2/2013 |
| KR | 20-2014-0003868 | U | 6/2014 |
| KR | 10-1533532 | B1 | 7/2015 |
| KR | 20-0478922 | Y1 | 12/2015 |

* cited by examiner

HANDMADE HANDBAG

FIELD OF THE INVENTION

The present invention relates to a handmade handbag, and more particularly, a handmade handbag that can be preserved semi-permanently by increasing the service life through maintaining cleanliness and easy management of the inside of the handmade handbag.

BACKGROUND OF THE INVENTION

In general, handbags are divided into men's and women's, and mainly indicate products of a structure that is easy to carry and hold by hand. In particular, since women usually carry more personal items than men, most handbag products target for women, and in fact, women's handbags are sold more than men's handbags.

Unlike men, women carry a lot of personal items due to their physical characteristics. For example, these personal items include cosmetic products such as lipsticks, lotions, brushes, eyeshadow palettes, cotton pads, and pouches, menstrual products such as sanitary pads, menstrual cups, and menstrual panties, personal ornaments such as earrings, rings, and necklaces, stockings, underwear such as panties and brassieres, wallets, and others. Therefore, handbags are particularly useful for women to conveniently store and carry these personal items.

Most of these women's handbags are made of natural leather and ready made products that are manufactured through a uniform automation process under the brand name. Since these products have a structure in which the inner space for storing personal items is almost sealed, air in the inner space is not smoothly ventilated.

Thus, most of the conventional women's handbags have a closed structure with insufficient air breathability in the inner space for storing personal items. Particularly in summer, when the temperature is high, lack of ventilation in the inner space causes deterioration of portable products, which generates even an unpleasant odor, thereby bothering people around them.

In addition, in the course of deterioration of items, a handbag is partially damaged due to chemical actions between the items and natural leather of the handbag. Since it is almost impossible to restore damage caused by such chemical actions, a high priced women's handbag is likely to no longer be used.

In particular, the main cause of deterioration and unpleasant odor of personal products is simultaneous occurrence of high temperature and lack of air breathability in an inner space, in a state where substances such as cosmetics, blood stains on menstrual panties, and dust are mixed with each other.

Moreover, menstrual panties are mostly stored deep inside the handbag so that they cannot be seen from the outside to protect women's privacy. This further promotes occurrence of unpleasant odors under conditions of high temperature and lack of air breathability.

Patent document disclosed in the following prior art document relates to an antitheft handbag. Most of the prior patent documents related to handbags are technologies for antitheft or locking.

(Patent Document 1) Korean Patent Application No. 10 2011 0079470.

DETAILED DESCRIPTION OF THE INVENTION

Technical Problems

An object of the present invention for solving the problems mentioned above is to provide a handmade handbag that can be customized for each individual and enable taking out women's portable items easily and ventilating air smoothly.

SUMMARY OF THE INVENTION

The present invention for achieving the objects described above is a handmade handbag that can be carried in a state in which portable items is stored therein, the handmade handbag is characterized in that it is configured to comprise a first handy storage part and a second handy storage part that are positioned on an outer portion of a storage part where the portable items are stored and that are mesh type partitioned structures for separately storing an item of the portable items that needs personal privacy protection and frequent taking out.

The handmade handbag is characterized in that each of the mesh type first and second simple storage part is configured by a combination of a hiding cover having a sewn type structure and a through hole.

The handmade handbag is characterized in that each of the mesh type first and second handy storage part includes: a handy flap configured to be detachably attached to an outer portion of the storage part; a mesh storage part located inside the handy flap, configured to have a mesh type structure, and storing items that is frequently taken out; and a mesh auxiliary storage part located inside the mesh storage part, configured in a mesh type structure inside the mesh storage part, and storing items that needs personal privacy protection.

The handmade handbag is characterized in that each of the mesh storage part and the mesh auxiliary storage part has a mesh frame structure and includes: a pattern type hiding cover having a sewn type structure and arranged in a specific pattern in the mesh frame, and a through hole arranged between the pattern type hiding cover, wherein the pattern type hiding cover is formed with a combination of one or more patterns among a letter type, a figure type, a design type, a pattern type, a photo type, a jewel type, and a national flag type pattern.

The handmade handbag is characterized in that in course of storing items that needs personal privacy protection in a storage space formed between the mesh auxiliary storage part and the outer portion of the storage part, the pattern type hiding cover arranged in a specific pattern in the mesh auxiliary storage part is revealed through the through hole configured in the mesh storage part and provides a beautiful appearance to the outside.

Technical Effects of the Invention

As described above, according to the present invention, items stored in the inner storage part of the handmade handbag can be prevented from deterioration, and thus, the handmade handbag can be prevented from being damaged.

In addition, according to the present invention, items that need frequent taking out or personal privacy protection can be easily stored in the outer portion of the inner storage part of the handmade handbag. In addition, the handmade handbag can provide splendor and lovely appearance by forming the hiding cover with a combination of various colors and patterns and exposing it to the outside.

BRIEF DESCRIPTION OF THE DRAWINGS

FIG. 7 is a front view of a conceptual drawing illustrating a state in which the mesh storage part 122 and the mesh auxiliary storage part 123 positioned inside the mesh storage part 122 to which an example of a pattern type hiding cover is applied, are in close contact with each other.

FIG. 8 is a front view of a conceptual drawing illustrating a state in which the mesh storage part 122 and the mesh auxiliary storage part 123 positioned inside the mesh storage part 122 to which another example of a pattern type hiding cover is applied, are in close contact with each other.

FIG. 9 is a front view of a conceptual drawing illustrating a state in which the mesh storage part 122 and the mesh auxiliary storage part 123 positioned inside the mesh storage part 122 to which another example of a pattern type hiding cover is applied, are in close contact with each other.

FIG. 10 is a front view of a conceptual drawing illustrating a state in which the mesh storage part 122 and the mesh auxiliary storage part 123 positioned inside the mesh storage part 122 to which another example of a pattern type hiding cover is applied, are in close contact with each other. FIG. 10 shows a combination of letters such as 'gorgeous' and patterns.

MODES FOR THE INVENTION

The accompanying drawings in the specification of the present invention are exaggerated for clarity and convenience of description. The embodiments described in the specification of the present invention are the most preferred embodiments of the present invention and do not represent all of the technical spirit of the present invention. Accordingly, it should be understood that the embodiments described in the specification of the present invention may have various equivalents and modifications that can be substituted for them at the time of filing of the present application. In addition, the scope of the present invention is not limited to the embodiments but includes several other modified embodiments. The scope of the present invention should be interpreted based on the technical idea throughout the specification.

In addition, in the description of the handmade handbag of the present invention, the reference number that refers to each part may be identically specified in different figures. However, even if the reference numbers are the same, the meaning of the terms referring to the reference numbers may be interpreted to be modified according to the embodiments.

The handmade handbag according to an embodiment of the present invention may be manufactured for men and women. Although the handmade handbag illustrated in FIG. 1 as an example is for women, the present invention is not limited thereto and may include a handmade handbag for men.

Figure 1:
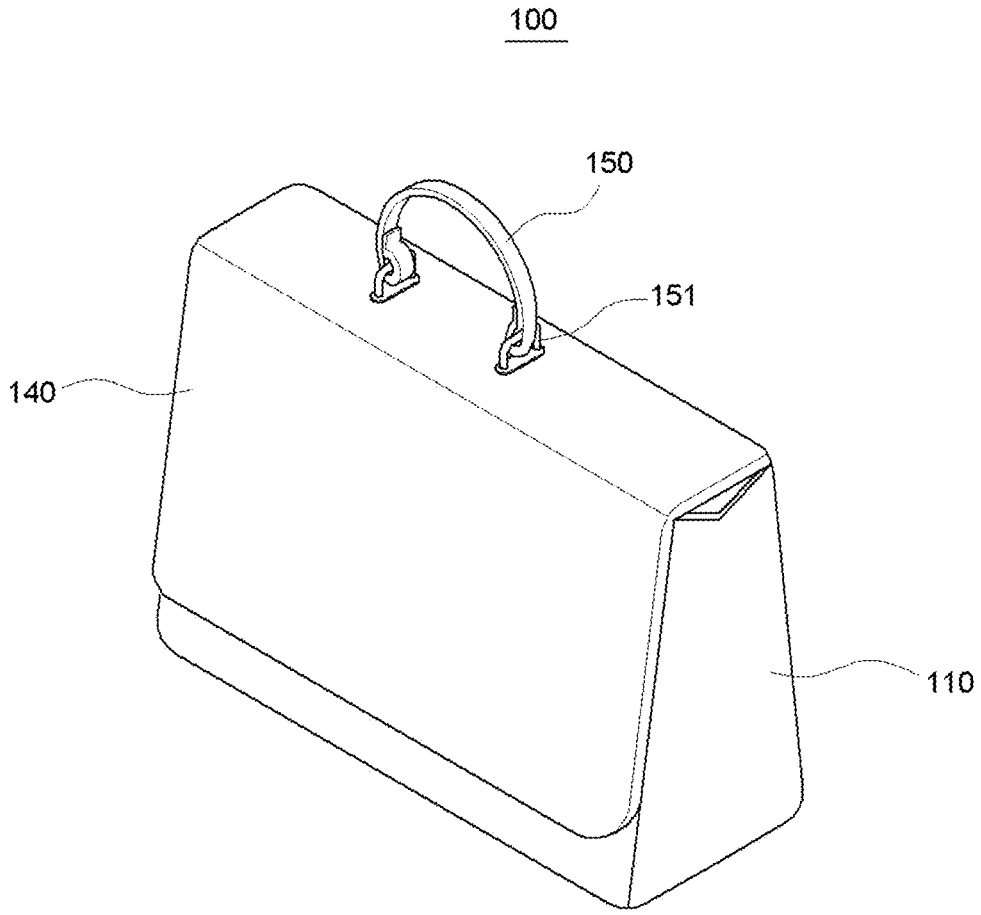
FIG. 1 is a three dimensional perspective view of a conceptual drawing illustrating a handmade handbag according to an embodiment of the present invention.

The handmade handbag 100 shown in FIG. 1 is a handmade handbag for women and is configured to conveniently store various personal portable items such as cosmetics, menstrual products, accessories, and valuables, and others. As shown in FIG. 1, the handmade handbag 100 may include a small sized storage part 110; a flap part 140 that closes the storage part 110, and a handle 150 that is located on the upper end of the flap part 140 and allows the handbag 100 to be easily carried by holding it. The handle 150 may be configured in such a way that it is connected to a connecting ring 151 integrally connected to the upper end of the flap part 140 but is not limited to such a connection structure.

The handmade handbag 100 is for women and may be made of natural leather or cloth but is not limited thereto.

The natural leather or cloth of the handmade handbag 100 may have a waterproof coating layer formed on its surface by a special waterproof coating treatment. This waterproof coating layer can prevent water from being absorbed into the handmade handbag 100 when it rains or snows and can also prevent being torn by objects such as sharp knives.

Figure 2:
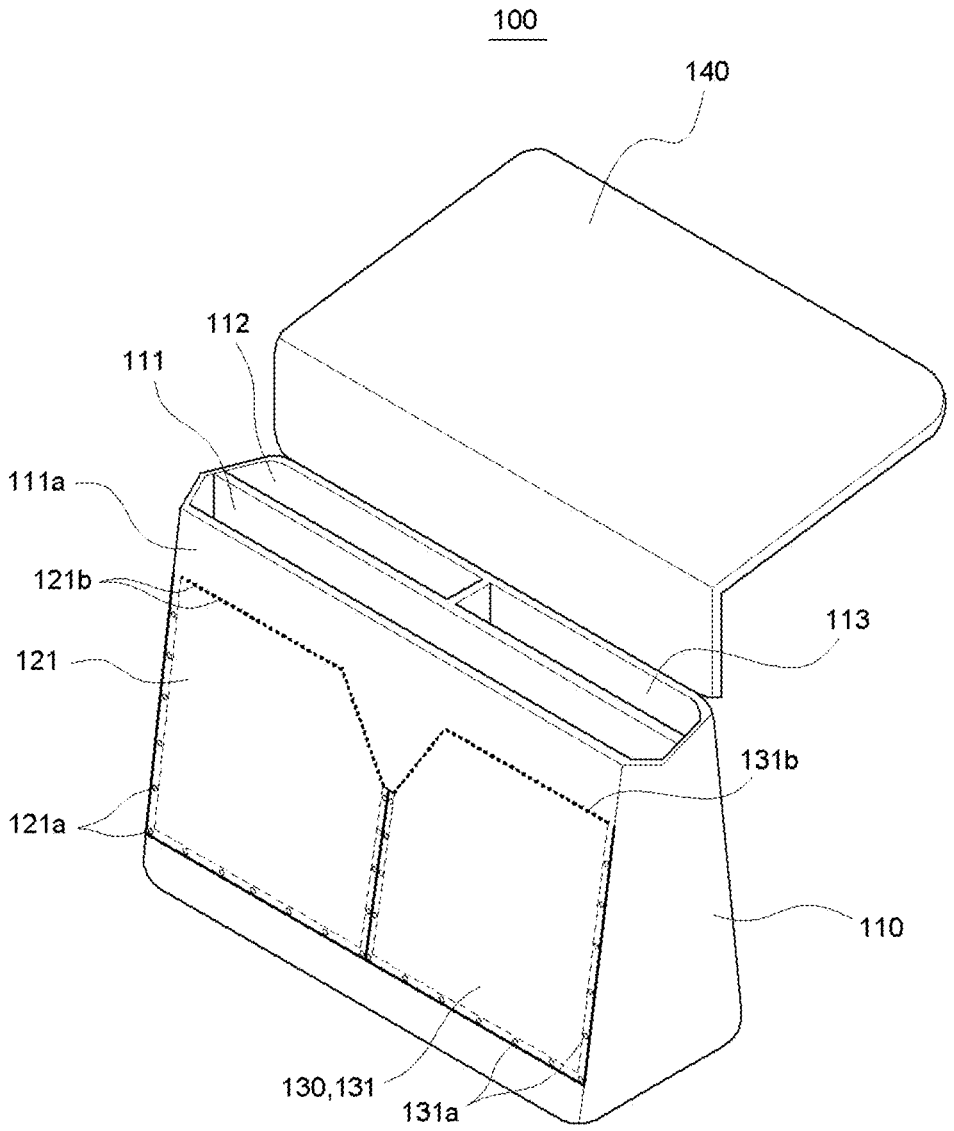
FIG. 2 is a three dimensional perspective view of a conceptual drawing illustrating a state in which a flap part of the handmade handbag of FIG. 1 is open.

As shown in FIG. 2, when the flap part 140 of the handmade handbag 100 is open, the storage part 110 may be completely exposed to the outside. The storage part 110 may include a large storage part 111, a medium storage part 112, and a small storage part 113 that are partitioned according to a size and a type of portable items, but the structure of the storage part 110 is not limited thereto. According to the individual woman's order, the handmade handbag 100 can be customized and applied with other various structure.

In particular, a first handy storage part and a second handy storage part may be configured on an outer surface 111*a* corresponding to an outer side of the large storage part 111. Among the personal items of women, items that are small and taken out frequently or that needs privacy protection can be stored in the first handy storage part and the second handy storage part in a simple and convenient manner. In this case, each of the first handy storage part and the second handy storage part has a mesh type structure and is partitioned independently from each other.

The first handy storage part is for a portable item that needs privacy protection. For example, the first handy storage part may be used to conceal and store certain items such as menstrual panties, stockings, or brassieres while allowing smooth air ventilation or breathability inside.

On the other hand, the second handy storage part is for a portable item that needs to be taken out frequently. For example, since items such as lipstick, lotion, brush, eye shadow palette, cotton pad, and pouch are frequently taken out or put in to fix makeup, the second handy storage part may be used to store these items.

As a storage for storing certain items that needs privacy protection, the first handy storage part further includes a handy flap 121; a mesh storage part 122 located inside the handy flap 121, and a mesh auxiliary storage part 123 located inside the mesh storage part 122.

Meanwhile, the second handy storage part may be configured to include only a handy flap 131 and a mesh storage part 132 positioned inside the handy flap 121. That is, the second handy storage part may be configured by omitting the mesh auxiliary storage portion 123 of the first handy storage part. However, the structure of the second handy storage part is not limited thereto and may further include a mesh auxiliary storage part having the same function as the mesh auxiliary storage part 123.

Although both the configurations of the first handy storage part and the second handy storage part may be described respectively, only the configuration of the first handy storage part will be described in detail below in order to avoid repetition of description. That is, since the configuration of the second handy storage part can be sufficiently described with reference to the configuration of the first handy storage part, a detailed description of the configuration of the second handy storage part will be omitted.

As described above, the first handy storage part is configured to include: the handy flap 121; the mesh storage part 122 located inside the handy flap 121, and the mesh auxiliary storage part 123 located inside the mesh storage part 122. The first handy storage part is formed on the outer surface 111*a* corresponding to the outside of the large storage part 111.

The handy flap 121 may be configured on the outer surface 111*a* in a structure in which a lower portion thereof and edge portions of both side portions thereof are open or closed and an edge portion of an upper portion thereof is completely combined. The second handy storage part may also be configured on the outer surface 111*a* in the same structure as the first handy storage part described above.

In the structure in which the first handy storage part and the second handy storage part are configured on the outer surface 111*a* corresponding to the outer side of the large storage part 111, the handy flap 121 may be formed in such a way that the lower portion and edge portions of both side portions thereof is open or closed but is not limited thereto.

However, if the handy flap 131 or the lower portion and edge portions of both side portions of the handy flap 121 are configured to be open or closed, it is advantageous in that items that need privacy protection, such as menstrual panties, can be hidden quickly and easily, and items that need to be taken out frequently, such as lipsticks, can be easily stored by being taken out and putting in frequently.

Figure 3:
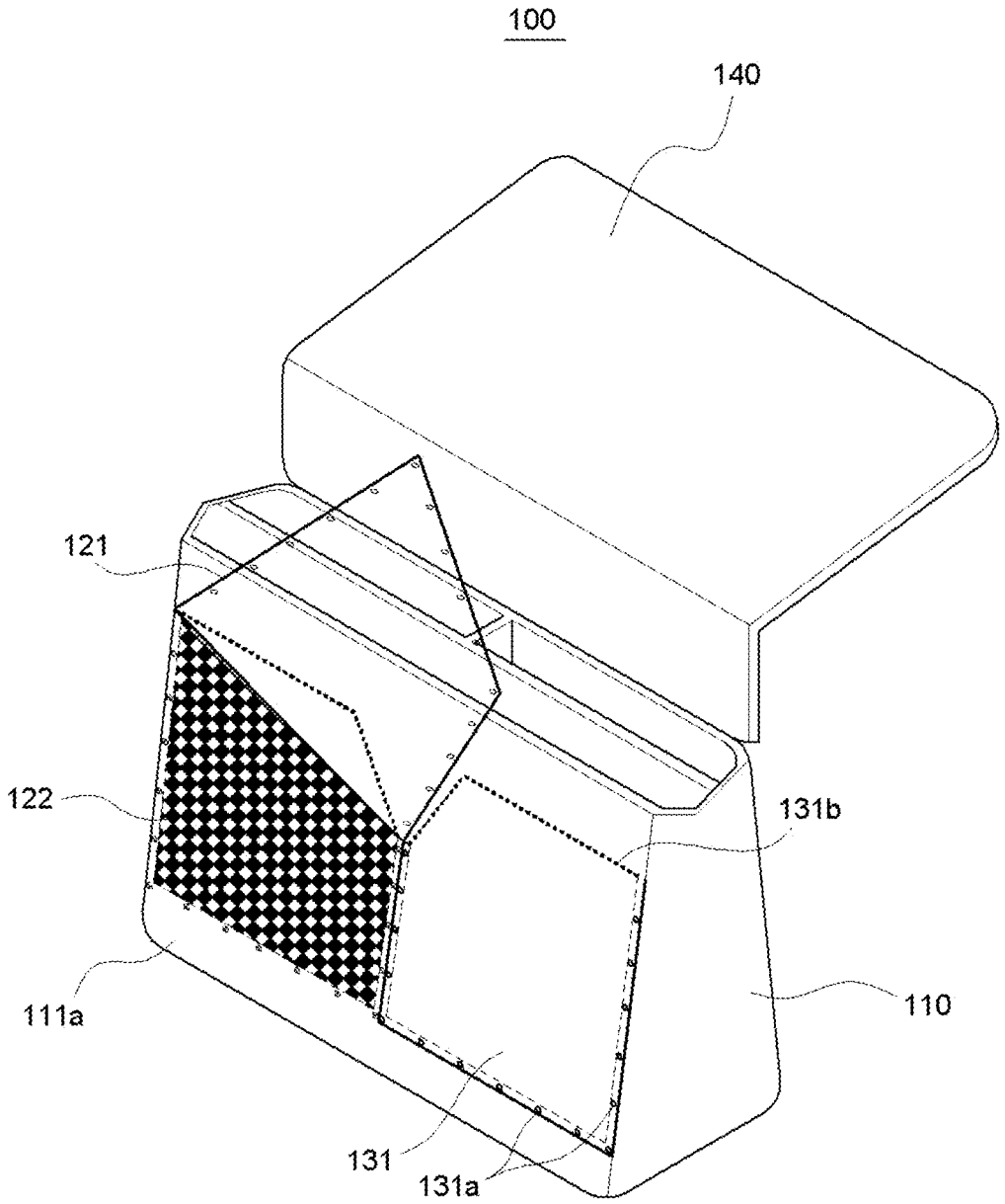
FIG. 3 is a three dimensional perspective view of a conceptual drawing illustrating a state in which a handy flap of a first handy storage part between the first handy storage part and a second simple storage part shown in FIG. 2 is open.

As shown in FIGS. 2 and 3, a detachable means, for example, a male and a female part of a snap button 121*a* can be applied to the lower portion and edge portions of both side portions of the handy flap 121. In addition, a coupling means, for example, a sewing knot 121*b* sewn with a sewing thread can be applied to the edge portion of the upper portion of the handy flap 121 and coupled to the outer surface 111*a*.

Likewise, a detachable means, for example, a male and a female part of a snap button 131*a* can be applied to the lower portion and edge portions of both side portions of the handy flap 131. In addition, a coupling means, for example, a sewing knot 131*b* sewn with a sewing thread can be applied to the edge portion of the upper portion of the handy flap 131 and coupled to the outer surface 111*a*.

Figure 4:
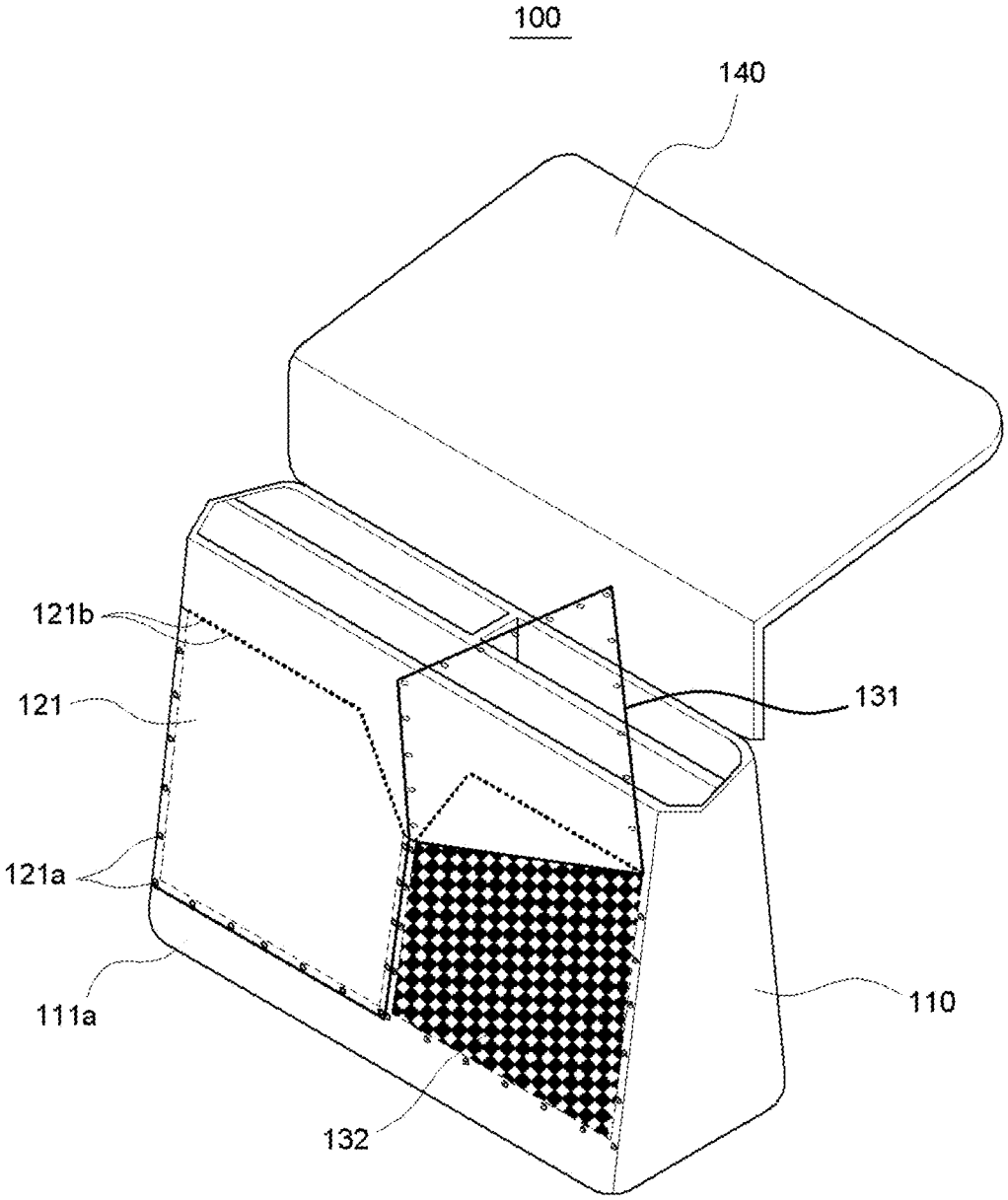
FIG. 4 is a three dimensional perspective view of a conceptual drawing illustrating a state in which a handy flap of the second simple storage part between the first handy storage part and the second simple storage part shown in FIG. 2 is open.

When the handy flap 121 is lifted upward and folded back in a state in which the male and female of the snap button 121*a* applied to the lower portion and edge portions of both side portions of the handy flap 121 are separated from each other, the mesh storage part 122 may be exposed as shown in FIG. 3. When the handy flap 131 is lifted upward and folded back in a state in which the male and female of the snap button 131*a* applied to the lower portion and edge portions of both side portions of the handy flap 131 are separated from each other, the mesh storage part 132 is It may be exposed as shown in FIG. 4.

Figure 5:
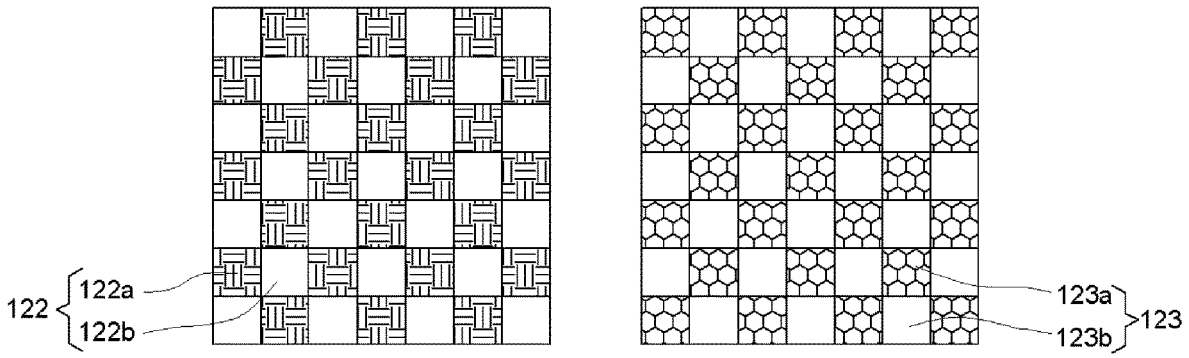
FIG. 5 is a front view of a conceptual drawing illustrating configurations of a mesh storage part 122 and a mesh auxiliary storage part 123 positioned inside the mesh storage part 122, which are exposed to the outside according to the opening of the handy flap 121 of the first handy storage part shown in FIG. 3.

The mesh storage part 122 exposed to the outside is configured to have a mesh frame of a certain partitioned structure as shown in FIG. 5. The mesh frame includes sewn hiding covers 122*a* having a specific pattern and through holes 122*b* provided therebetween.

In addition, the mesh auxiliary storage part 123 is formed to be spaced apart by a predetermined distance inside the mesh storage part 122 exposed to the outside and has a mesh frame of a predetermined partitioned structure as shown in FIG. 5. The mesh frame includes sewn hiding covers 123*a* of a specific pattern and through holes 123*b* provided therebetween. The sewn hiding cover 123*a* of the mesh auxiliary storage part 123 is formed in a place of the mesh frame, which is corresponding to a position of the through hole 122*b* of the mesh frame of the mesh storage part 122. The through hole 123*b* of the mesh auxiliary storage part 123 is formed in a place of the mesh frame, which is corresponding to a position of the sewn hiding cover 123*a* of the mesh storage part 122. The sewn hiding cover 123*a* of the mesh auxiliary storage part 123 may have a pattern that is different from the sewn hiding cover 122*a* of the mesh storage part 122.

Figure 6:
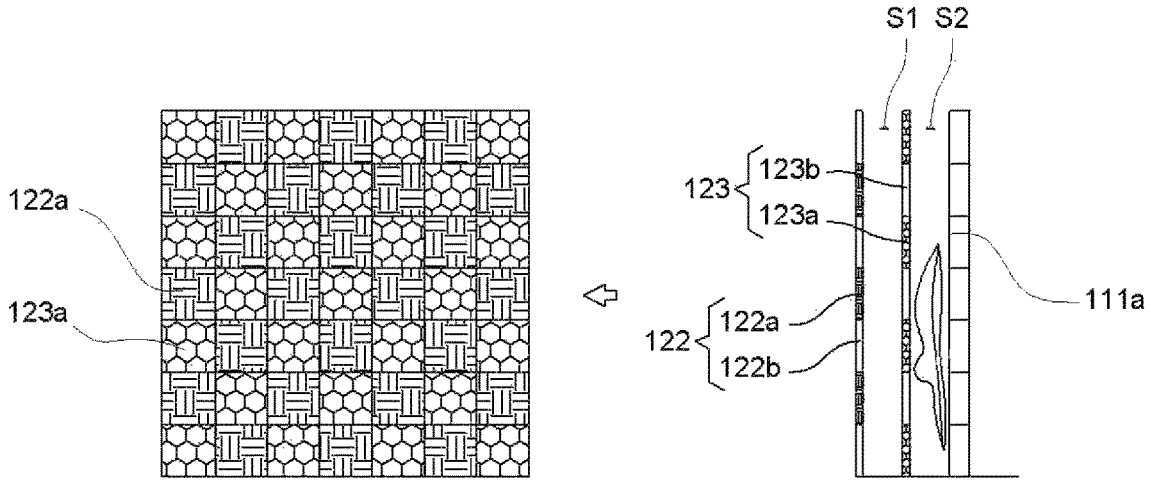
FIG. 6 is a front view of a conceptual drawing illustrating a state in which the mesh storage part 122 and the mesh auxiliary storage part 123 positioned inside the mesh storage part 122 are in close contact with each other and a portable article (E.g., menstrual panties) stored in the mesh auxiliary storage part 123 is not visible from the outside.

A first storage space S1 is formed between the mesh storage part 122 and the mesh auxiliary storage part 123 as shown in FIG. 6, and a second storage space S2 is formed between the mesh auxiliary storage part 123 and the outer surface 111*a* of the large sized storage part 111 as shown in FIG. 6.

Therefore, when the handy flap 121 of the first handy storage part is open, items that need protect privacy such as menstrual panties can be quickly hidden and stored in the second storage space S2 provided between the mesh auxiliary storage portion 123 and the outer surface 111*a* of the large storage portion 111. When the menstrual panties are stored in the second storage space S2, the mesh auxiliary storage part 123 is in close contact with the mesh storage part 122 positioned in front of the mesh auxiliary storage part 123. Accordingly, the through hole 122*b* of the mesh storage part 122 is covered by the sewn hiding cover 123*a*, the through hole 123*b* of the mesh auxiliary storage part 123 is covered by the sewn hiding cover 122*a* of the mesh storage part 122. Thus, the menstrual panties stored in the second storage space S2 are not visible from the outside and personal privacy can be protected.

Even if the menstrual panties are stored in the second storage space S2 for a long time, when the storage part 110 of the handmade handbag 100 is open, the flap part 140 is open from time to time and outside air flows in toward a direction of the storage part 110. Accordingly, the outside air can also easily flow into a gap between the sewn hiding cover 122*a* and the through hole 123*b*, a gap between the sewn hiding cover 123*a* and the through hole 122*b*, or a fine gap within the sewn hiding cover 122*a*, 123*a*. Accordingly, smooth ventilation can be ensured in the second storage space S2, and deterioration that may occur due to chemical actions caused by menstrual blood stains on menstrual panties stored in the second storage space S2 can be prevented.

In addition, since the sewn hiding cover 122*a* of the mesh storage part 122 and the sewn hiding cover 123*a* of the mesh auxiliary storage part 123 have different sewn patterns, they provide a unique aesthetic effect.

Meanwhile, the sewn hiding cover 122*a*, 123*a* configured in each of the mesh frames of the mesh storage part 122 and the mesh auxiliary storage part 123 may be configured as another example of a patterned hiding cover for aesthetic effect. An example of a patterned hiding cover may be a sewn type of a figure shape as shown in FIG. 7.

Figure 7:
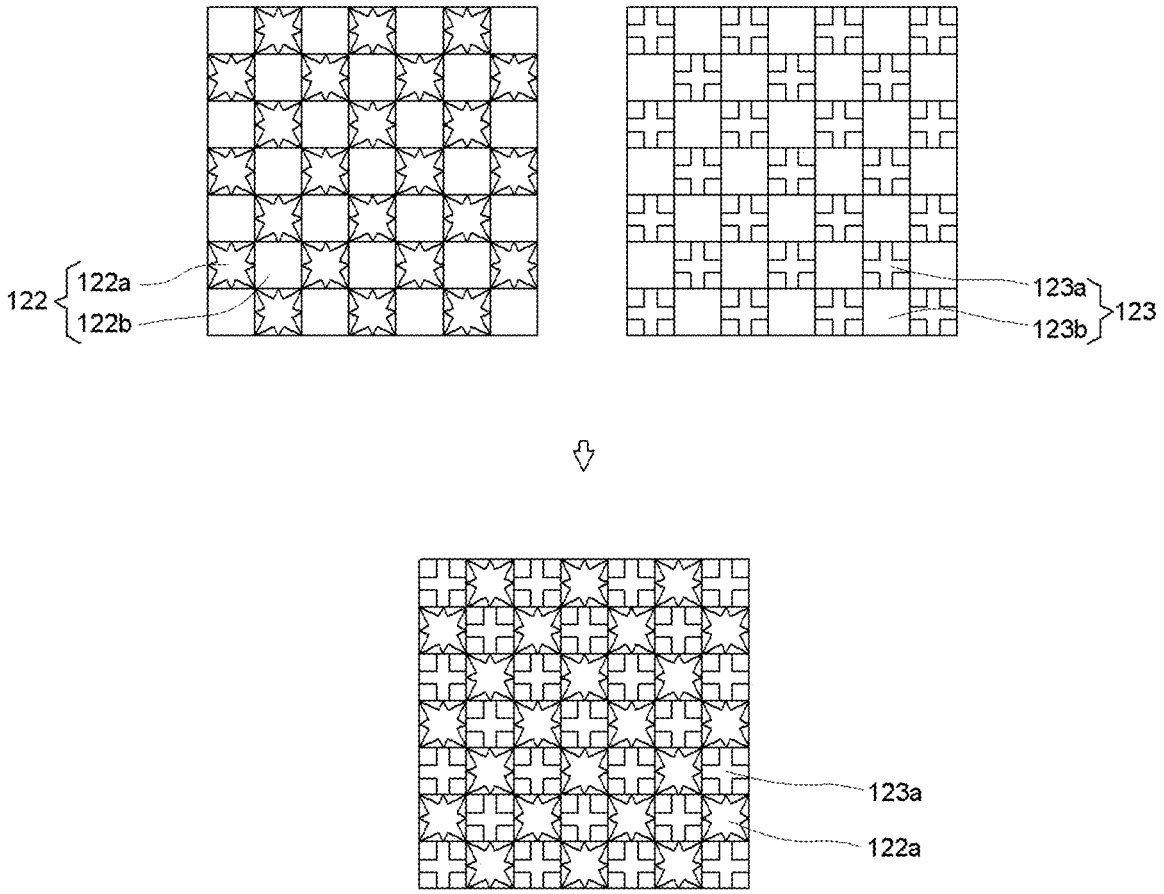
FIG. 7 is another embodiment of configurations of the mesh storage part 122 and the mesh auxiliary storage part 123 positioned inside the mesh storage part 122 shown in FIGS. 3 and 4.

That is, as shown in FIG. 7, the mesh frame of the mesh storage part 122 is configured with sewn hiding covers 122*a* and through holes 123*b*, and the mesh frame of the mesh auxiliary storage part 123 is configured with sewn hiding covers 123*a* and through holes 123*b*. Specifically, star shaped figures may be arranged in a specific pattern of the sewn hiding cover 122*a* in the mesh frame of the mesh storage part 122, and the through holes 122*b* are arranged between the sewn hiding covers 122*a* having the star shaped figures. Meanwhile, cross shaped figures may be arranged in a specific pattern of the sewn hiding cover 123*a* in the mesh frame of the mesh auxiliary storage part 123, and through holes 123*b* are arranged between the sewn hiding cover 123*a* having the cross shaped figure.

Therefore, when the menstrual panties are stored in the second storage space S2, the mesh auxiliary storage part 123 is in close contact with the mesh storage part 122 located in front of the mesh auxiliary storage part 123 according to volume expansion of the second storage space S2. The sewn hiding cover 123*a* having the cross shaped figure covers the through holes 122*b* between the sewn hiding cover 122*a* having the star shaped figure, and the through holes 123*b* between the sewn hiding cover 123*a* having the cross shaped figure are covered by the sewn hiding cover 122*a* having the star shaped figure. Therefore, the menstrual panties are not visible from the outside at all, and the combination of the star shaped figure of the sewn hiding cover 122*a* and the cross shaped figure of the sewn hiding cover 123*a* enhances aesthetic effects.

In addition, some of the meshes included in the mesh storage part 122 and the mesh auxiliary storage part 123 may include a flexible tube having an emitting through hole structure and natural fragrance pellets inside the tube, which can emit a fragrance to the outside. The natural fragrance pellets may be made of, for example, herbs having an aromatic fragrance but is not limited thereto.

That is, the mesh having a structure surrounding the tube may be configured as a mesh box having a sewn structure, and the natural fragrance pellets positioned inside the tube may emit a fragrance to the outside through the emitting through hole of the tube.

Therefore, when a holder of the handmade handbag is in a closed public facility such as inside a subway in a state in which menstrual panties are stored in the second storage space S2, the holder can stimulate the mesh box surrounding the tube, by hand, and the fragrance emitted from the natural fragrance pellets by the external stimulation is radiated to the outside through the emitting through holes of the tube and the mesh box of the sewn structure. Accordingly, unpleasant odor from the menstrual panties can be diluted with this fragrance emitted from the natural fragrance pellets.

Meanwhile, when the natural fragrance pellets no longer emit fragrance after an expiration date, it can be replaced with new natural fragrance pellets. For replacement of the pellets, the mesh box surrounding the tube can be configured with a detachable fastening structure, which can be detachable from the mesh. This detachable fastening structure may have a structure in which one end of both ends of the mesh box is detachable from the mesh, and the other end is always connected to the mesh in a sewing manner.

Since the mesh box has a sewn type structure surrounding the tube and one end of the mesh box has a detachable fastening structure, when replacement of natural fragrance pellets is required, one end of the mesh box is separated from the mesh and the tube inside the mesh box can be taken out. Then, as a zipper connected to one end of the tube is open, new natural fragrance pellets can be easily replaced.

Meanwhile, the sewn hiding cover 122*a*, 123*a* configured in each of the mesh frames of the mesh storage part 122 and the mesh auxiliary storage part 123 may be configured as another example of a patterned hiding cover for aesthetic effect. An example of a patterned hiding cover may be a sewn type of a combined shape of letters and patterns as shown in FIG. 8.

Figure 8:
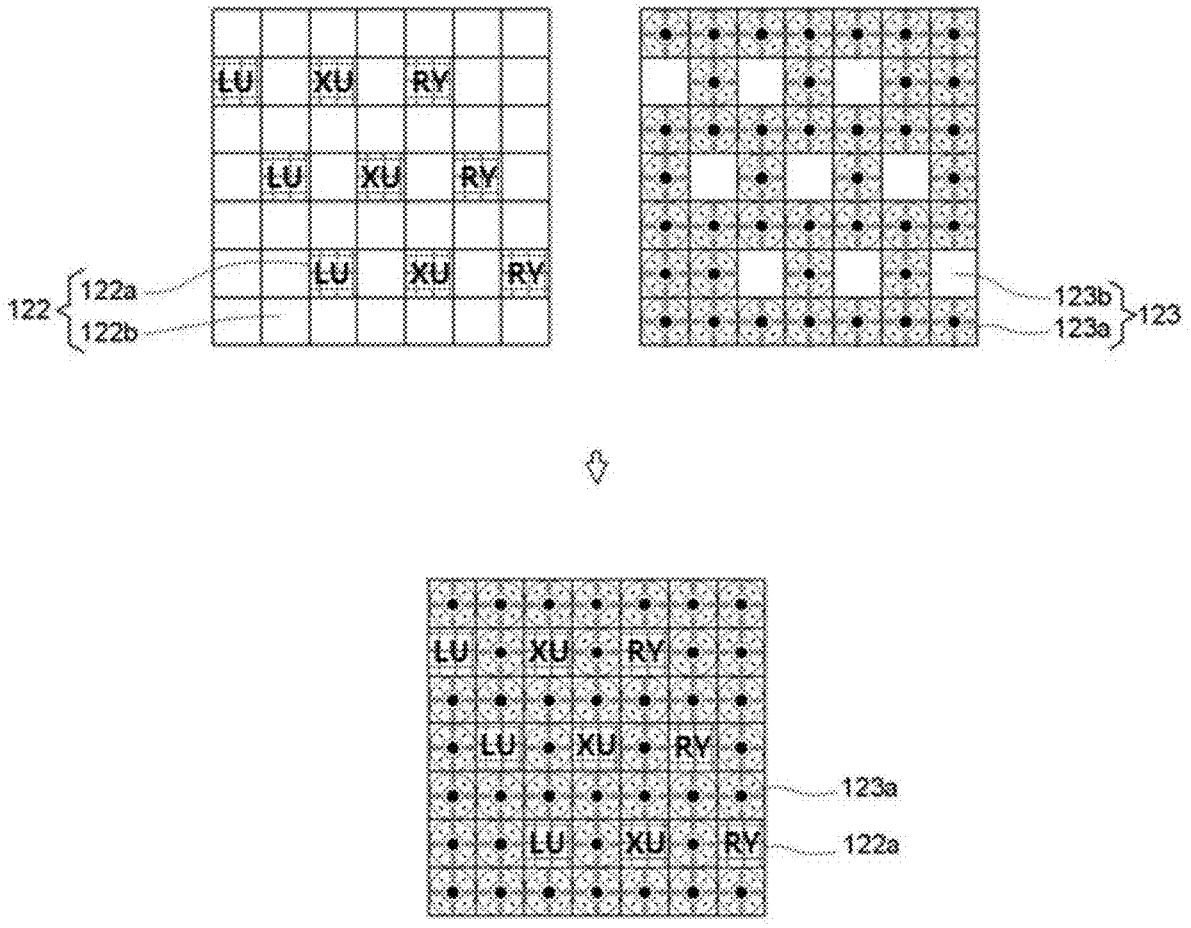
FIG. 8 is another embodiment of configurations of the mesh storage part 122 and the mesh auxiliary storage part 123 positioned inside the mesh storage part 122 shown in FIGS. 3 and 4.

That is, as shown in FIG. 8, the mesh frame of the mesh storage part 122 is configured with sewn hiding covers 122*a* and through holes 122*b*, and the mesh frame of the mesh auxiliary storage part 123 is configured with sewn hiding covers 123*a* and through holes 123*b*. Specifically, letters such as 'LUXURY,' which can symbolically mark the high quality of the handmade handbag 100, may be arranged in a specific pattern of the hiding cover 122*a* in the mesh frame of the mesh storage part 122, and the through holes 122*b* are arranged between the hiding cover 122*a* having the letters of 'LUXURY.' Meanwhile, certain patterns may be arranged in a specific pattern of the sewn hiding cover 123*a* in the mesh frame of the mesh auxiliary storage part 123, and through holes 123*b* are arranged between the sewn hiding cover 123*a* having the certain patterns.

Therefore, when the menstrual panties are stored in the second storage space S2, the mesh auxiliary storage part 123 is in close contact with the mesh storage part 122 located in front of the mesh auxiliary storage part 123 according to volume expansion of the second storage space S2. The sewn hiding cover 123*a* having the certain patterns covers the through holes 122*b* between the sewn hiding cover 122*a* having the letters of 'LUXURY,' and the through holes 123*b* between the sewn hiding cover 123*a* having the certain pattern are covered by the sewn hiding cover 122*a* having the letters of 'LUXURY.' Therefore, the menstrual panties are not visible from the outside at all, and the combination of the letters of 'LUXURY' of the sewn hiding cover 122*a* and the certain pattern of the sewn hiding cover 123*a* enhances aesthetic effects.

Meanwhile, the sewn hiding cover 122*a*, 123*a* configured in each of the mesh frames of the mesh storage part 122 and the mesh auxiliary storage part 123 may be configured as another example of a patterned hiding cover for aesthetic effect. An example of a patterned hiding cover may be a sewn type of a combined shape of letters and designs as shown in FIG. 9.

Figure 9:
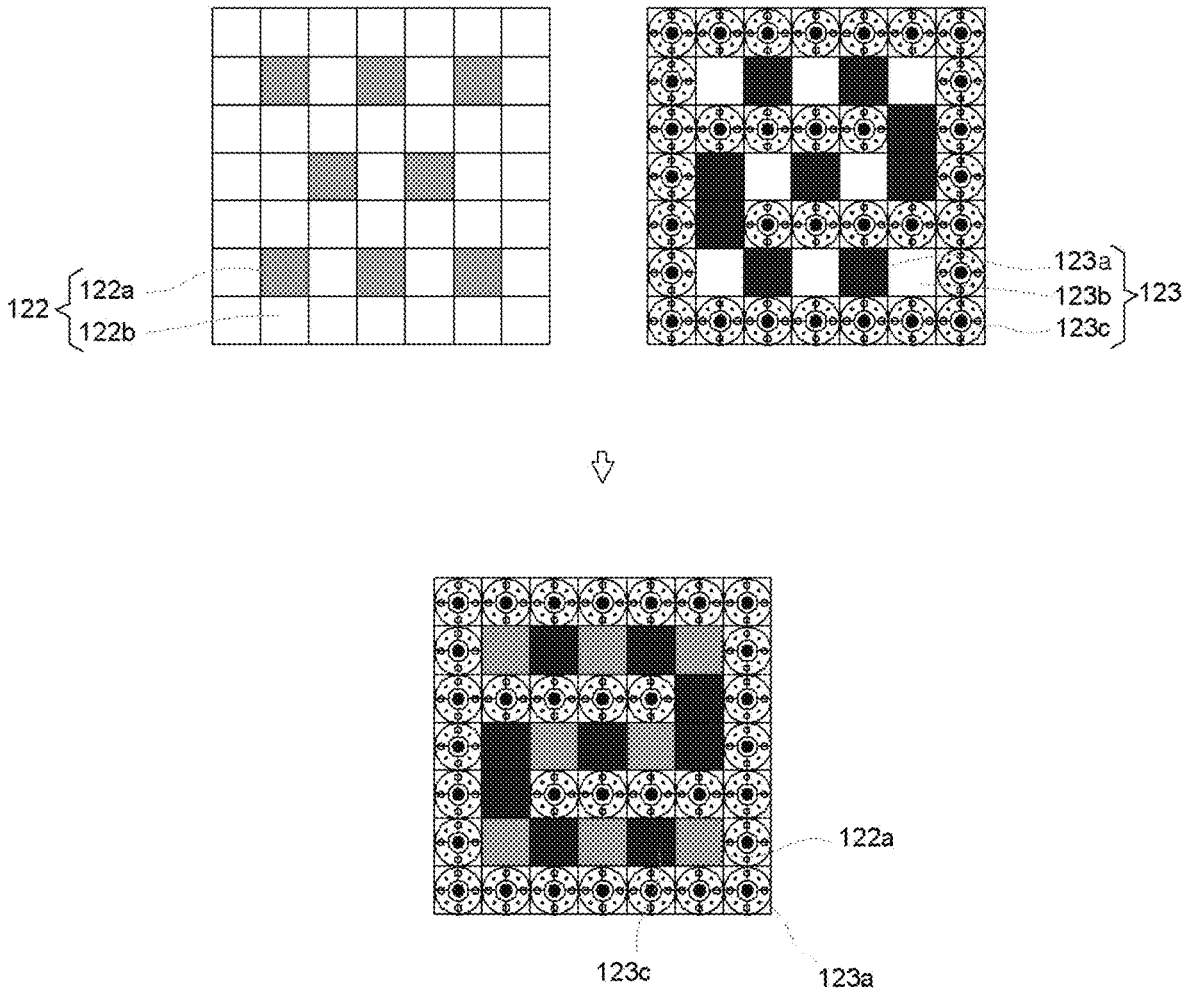
FIG. 9 is another embodiment of configurations of the mesh storage part 122 and the mesh auxiliary storage part 123 positioned therein shown in FIGS. 3 and 4.

That is, as shown in FIG. 9, the mesh frame of the mesh storage part 122 is configured with sewn hiding covers 122*a* and through holes 122*b*, and the mesh frame of the mesh auxiliary storage part 123 is configured with sewn hiding covers 123*a*, through holes 123*b*, and designs 123*c*. Specifically, letters, such as a specific consonant (E.g., reversed 'S') with a unique color may be selected as a mark that only the owner of the handmade handbag 100 can recognize and applied to the handmade handbag 100. A portion of length sections of the specific consonant with a unique color (E.g., reversed 'S' in orange color) may be arranged in a specific pattern of the sewn hiding cover 122*a*, and the through holes 122*b* are arranged around the sewn hiding cover 122*a* having the specific consonant (E.g., reversed 'S' in orange color). Meanwhile, the other portion of the length sections of the specific consonant with a different unique color (E.g., reversed 'S' in blue color) may be arranged in a specific pattern of the sewn hiding cover 123*a* in the mesh frame of the mesh auxiliary storage part 123. The through holes 123*b* are arranged between the sewn hiding cover 123*a* having the specific consonant (E.g., reversed 'S' in blue color), and the designs 123*c* may be arranged around the sewn hiding cover 123*a*.

Therefore, when the menstrual panties are accommodated in the second storage space S2, the mesh auxiliary storage part 123 is in close contact with the mesh storage part 122 located in front of the mesh auxiliary storage part 123 according to volume expansion of the second storage space S2. The sewn hiding cover 123*a* having the unique color (E.g., blue color) and specific consonant (E.g., reversed 'S') covers the through holes 122*b* between the sewn hiding cover 122*a* having the different unique color (E.g., orange color) and specific consonant (E.g., reversed 'S'). In addition, the through holes 123*b* between the sewn hiding cover 123*a* having the unique color (E.g., blue color) and specific consonant (E.g., reversed 'S') are covered by the sewn hiding cover 122*a* having the different unique color (E.g., orange color) and specific consonant (E.g., reversed 'S'). Therefore, the menstrual panties are not visible from the outside at all, and the combination of the sewn hiding cover 122*a* having the different unique color (E.g., orange color) and specific consonant (E.g., reversed 'S') and the sewn hiding cover 123*a* having the unique color (E.g., blue color) and specific consonant (E.g., reversed 'S' enhances aesthetic effects.

In this case, since the sewn hiding cover 122*a* of the mesh storage part 122 and the sewn hiding cover 123*a* of the mesh auxiliary storage part 123 are displayed in different colors (E.g., orange and blue color), the specific consonant (E.g., reversed 'S') can be further differentiated. In addition, since splendid designs 123*c* around the consonant can be displayed to the outside and provide a lovely and luxurious aesthetic effect.

Meanwhile, the sewn hiding cover 122*a*, 123*a* configured in each of the mesh frames of the mesh storage part 122 and the mesh auxiliary storage part 123 may be configured as another example of a patterned hiding cover for aesthetic effect. An example of a patterned hiding cover may be a sewn type of a combination of English alphabet and a combination of designs as shown in FIG. 10.

Figure 10:
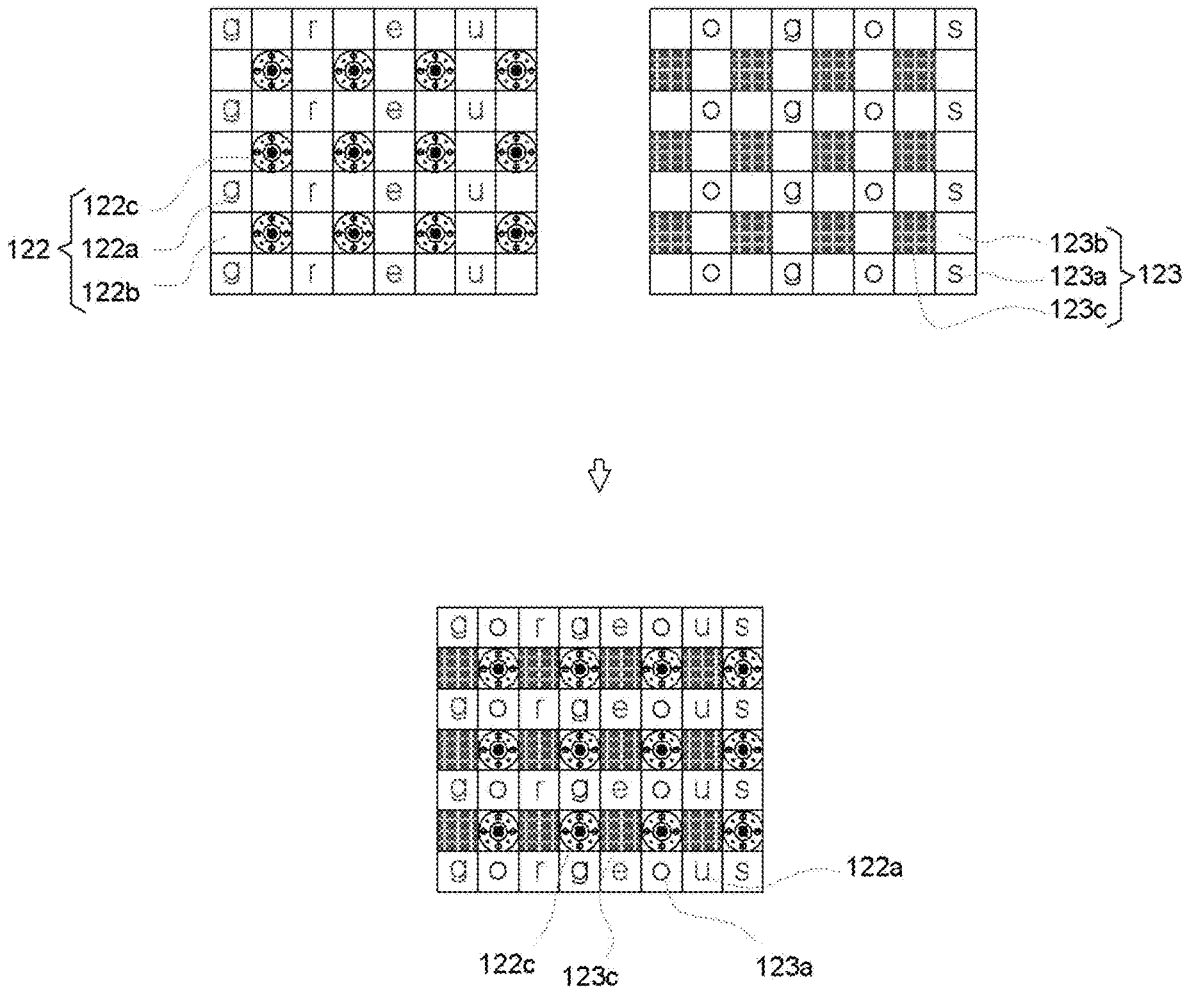
FIG. 10 is another embodiment of configurations of the mesh storage part 122 and the mesh auxiliary storage part 123 positioned therein shown in FIGS. 3 and 4.

As shown in FIG. 10, the mesh frame of the mesh storage part 122 is configured with sewn hiding covers 122*a*, through holes 122*b*, and designs 122*c*, and the mesh frame of the mesh auxiliary storage part 123 is configured with sewn hiding covers 123*a*, through holes 123*b*, and designs 123*c*. Specifically, an English word 'gorgeous,' which means luxurious, can be formed in the mesh frame of the mesh storage part 122 and the mesh auxiliary storage part 123 to inform the quality of the handmade handbag 100. The English word 'gorgeous' formed in the mesh frame of the mesh storage part 122 and the mesh auxiliary storage part 123 may be configured to be displayed through close contact between the mesh storage part 122 and the mesh auxiliary storage part 123.

That is, in the mesh of a grid structure of the mesh storage part 122, letters 'g, r, e, u' (E.g. English letters in red color) of the English word 'gorgeous' may be arranged in the sewn hiding cover 122*a* in such a way that each letter is spaced apart by one space for the through hole 122*b*. Designs 122*c* may be arranged in positions of some of the through holes 122*b* except for positions of the arrangement of the 'g, r, e, u' letters (E.g. English letters in red color) in a pattern in which each design 122*c* is spaced apart by one space.

In the mesh of a grid type structure of the mesh auxiliary storage part 123, letters 'o, g, o, s' (E.g. English letters in blue color) of the English word 'gorgeous' may be arranged in the sewn hiding cover 123*a* in such a way that each letter is spaced apart by one space for the through hole 123*b*. Designs 123*c* may be arranged in positions of some of the through holes 123*b* except for positions of the arrangement of the 'o, g, o, s' (E.g. English letters in blue color) in a pattern in which each design 123*c* is spaced apart by one space.

Therefore, when the menstrual panties are stored in the second storage space S2, the mesh auxiliary storage part 123 is in close contact with the mesh storage part 122 located in front of the mesh auxiliary storage part 123 according to volume expansion of the second storage space S2. The sewn hiding cover 123*a* having the English letters in blue color (E.g., 'o, g, o, s') are revealed through the through holes 122*b* between the sewn hiding cover 122*a* having the English letters in red color (E.g., 'g, r, e, u'). In addition, designs 123*c* are revealed through the through holes 122*b* between the designs 122*c*. Therefore, the menstrual panties are not visible from the outside at all, the English word (E.g., 'gorgeous') can be displayed in more than two colors, and a combination of designs in various colors appears around the English word. Accordingly, the mesh storage part 122 and the mesh auxiliary storage part 123 for concealment purposes also provide a more gorgeous appearance, and the handmade handbag 100 can visualize the high quality.

Figure 11:
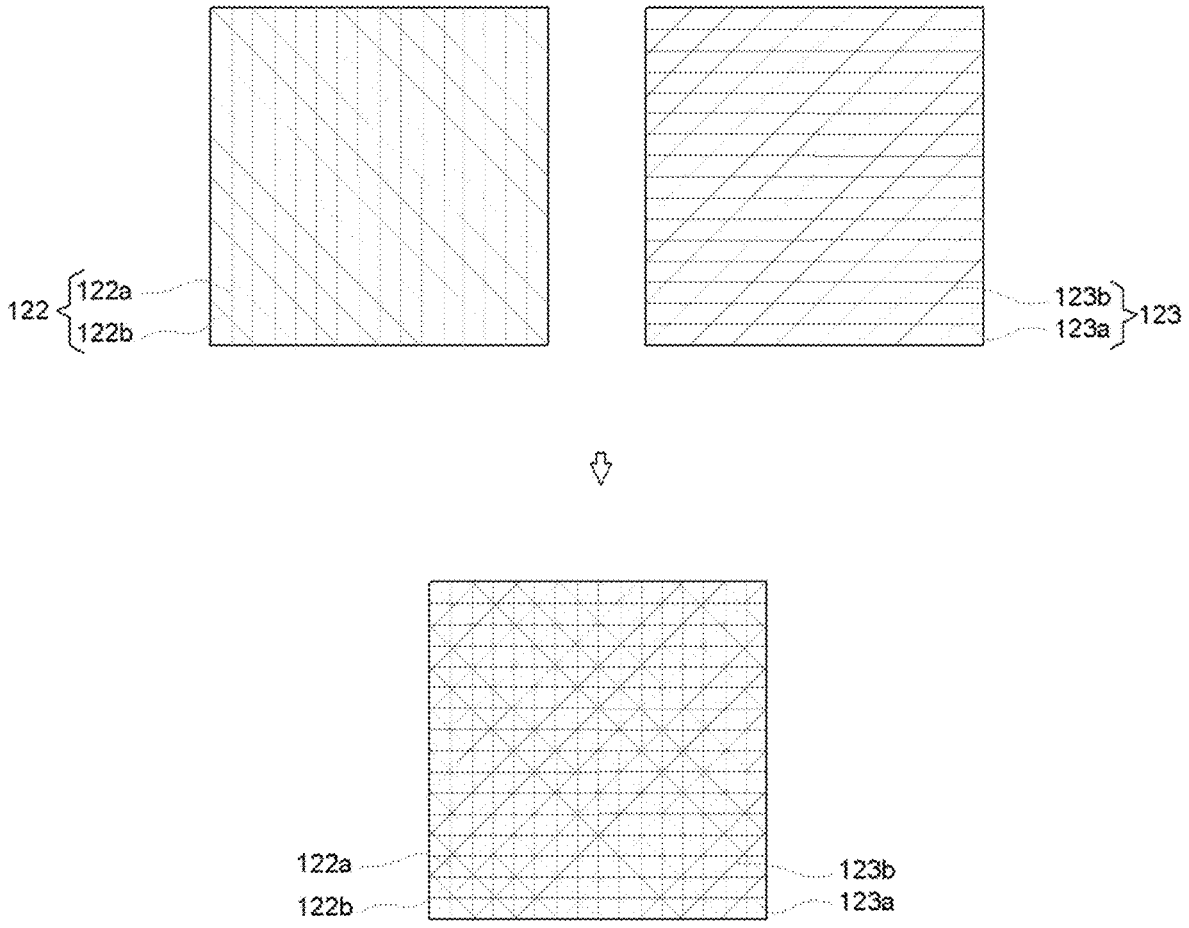
FIG. 11 is a drawing illustrating different arrangement patterns of meshes in configurations of the mesh storage part 122 and the mesh auxiliary storage part 123 positioned inside the mesh storage part 122 shown in FIG. 4.

Meanwhile, as shown in FIG. 11, various mesh structures may be selected in the mesh storage part 122 and the mesh auxiliary storage part 123. The two meshes 122*a*, 122*b* of the mesh storage part 122, which are in different colors, may be configured in a vertical and a left slope arrangement structure, respectively, and the two meshes 123*a*, 123*b* of the mesh auxiliary storage part 123, which are in different colors, may be configured in a horizontal and a right slope arrangement structure, respectively. Each reference number 122*a*, 122*b*, 123*a*, and 123*b* shown in FIG. 11 indicate a mesh and does not mean a through hole, and thus, it should be understood that a reference number for through holes is omitted.

Therefore, when the menstrual panties are stored in the second storage space S2, the mesh auxiliary storage part 123 is in close contact with the mesh storage part 122 located in front of the mesh auxiliary storage part 123 according to volume expansion of the second storage space S2. The two meshes 123*a*, 123*b* of the mesh auxiliary storage part 123 are revealed through two meshes 122*a*, 122*b* of the mesh storage part 122. Accordingly, the entire mesh 122*a*, 122*b*, 123*a*, 123*b* is configured in a denser arrangement, thereby providing a masking function by which it is difficult to recognize the item being concealed as menstrual panties. In addition, the entire mesh 122*a*, 122*b*, 123*a*, 123*b* is configured with a combination of various colors and arrangement patterns, thereby providing a beautiful appearance of the mesh storage part 122 and the mesh auxiliary storage part 123.

The sewn pattern type hiding cover and the through hole are an example of a configuration applied to the mesh frame of the mesh storage part 122 and mesh auxiliary storage part 123 described above but are not limited thereto. In order to provide a customized handmade handbag by a client order, the patterned hiding cover may be a pattern type, a photo type, a jewel type, and the like.

What is claimed is:

1. A handmade handbag that can be carried in a state in which portable items is stored therein, the handmade handbag comprising a first handy storage part and a second handy storage part that are positioned on an outer portion of a storage part for storing the portable items and that are mesh type partitioned structures for separately storing an item of the portable items that needs personal privacy protection and frequent taking out, wherein each of the first and second handy storage parts includes:

a handy flap configured to be detachably attached to an outer portion of the storage part;

a mesh storage part located inside the handy flap, configured to have a mesh type structure, and to store items that is frequently taken out; and a mesh auxiliary storage part located inside the mesh storage part, configured in a mesh type structure inside the mesh storage part, and to store items that needs personal privacy protection, wherein each of the mesh storage part and the mesh auxiliary storage part has a mesh frame structure and includes:

a pattern type hiding cover having a sewn type structure and arranged in a specific pattern in the mesh frame, and a through hole arranged between the pattern type hiding cover, wherein the pattern type hiding cover is formed with a combination of one or more patterns among a letter type, a figure type, a design type, a pattern type, a photo type, a jewel type, and a national flag type pattern, wherein the pattern type hiding cover and the through hole of the mesh auxiliary storage part are formed at positions corresponding to the through hole and the pattern type hiding cover of the mesh storage part, respectively.

2. The handmade handbag of claim 1, wherein in course of storing items in a storage space formed between the mesh auxiliary storage part and the outer portion of the storage part, the pattern type hiding cover arranged in a specific pattern in the mesh auxiliary storage part is revealed through the through hole configured in the mesh storage part.

* * * * *